United States Patent [19]

Ahrens et al.

[11] Patent Number: 4,799,533

[45] Date of Patent: Jan. 24, 1989

[54] HORIZONTAL CONTINUOUS CASTING MOLD

[75] Inventors: Max Ahrens; Manfred Haissig, both of Irvine, Calif.

[73] Assignee: Steel Casting Engineering, Ltd., Orange, Calif.

[21] Appl. No.: 876,845

[22] Filed: Jun. 20, 1986

[51] Int. Cl.[4] ..... B22D 11/00

[52] U.S. Cl. ..... 164/137; 164/418; 164/440

[58] Field of Search ..... 164/137, 341, 342, 418, 164/440, 490

[56] References Cited

U.S. PATENT DOCUMENTS 4,507,714 4/1979 Atkins et al. ..... 164/418

FOREIGN PATENT DOCUMENTS 155836A 9/1985 European Pat. Off. ..... 164/418

*Primary Examiner*—Fred A. Silverberg
*Assistant Examiner*—Richard K. Seidel
*Attorney, Agent, or Firm*—Roy A. Ekstrand

[57] ABSTRACT

An improved, more economical mold for use in continuously casting metals or alloys comprises a mold tube and a pair of flanges, one flange peripherally disposed of and in abutting, liquid sealing relation with each end of the tube. Such sealing relation is preferably provided by a continuous knife-edged protrusion formed in and disposed peripherally of each flange and adapted to sealingly cooperate with a continuous shallow groove formed in and disposed peripherally of each end of the tube. Cooling means including a jacket and a baffle surround the tube between the flanges, and the baffle further defines a channel immediately circumjacent a substantial portion of the outer surface of the tube for directing a flow of cooling liquid about the tube in direct contact with such surface. Removable assembly means releasably interconnect the two flanges and the baffle disposed therebetween in such a way as to clamp each of the flanges to its respective end of the mold tube, thus effecting both liquid-tight seals as well as creating a unitary assembly. Accordingly, an efficient method for repairing the mold via quick dissassembly, tube replacement and quick reassembly is also provided.

10 Claims, 3 Drawing Sheets

HORIZONTAL CONTINUOUS CASTING MOLD

FIELD OF THE INVENTION

This invention relates to apparatus for horizontally, continuously casting steel or other alloys or metals, and more particularly to an improved mold for inclusion in such apparatus as a component thereof.

BACKGROUND OF THE INVENTION

The molds used in horizontal continuous casting apparatus normally provide a smooth, substantially axially uninterrupted interior surface of a cross-sectional shape corresponding to that of the desired cast product, such as, for example, round bar or square billet. Such surface wears in the normal course of use, requiring periodic replacement, and is also from time to time subject to accidental marring, thus requiring unscheduled replacement.

In order to provide both reasonable strength and good heat conductivity for solidifying molten metal to form the outer shell of the product being cast, continuous casting molds are typically made of a relatively expensive copper alloy, such as beryllium-copper, for example. Relatively complex flanges are required at either end of the mold, for mating such mold with the water jacket or similar cooling apparatus which surrounds the mold exterior, as well as for mating such mold both with the refractory materials interposed between the mold and the tundish and slide gate on the one end, and with the primary aftercooler or similar apparatus on the other end.

Heretofore, these molds have been of unitary construction with the required flanges, thus necessitating the replacement of both the actual casting portion of the mold and both flanges each time that either normal wear or accidental damage to the casting surface so indicates, even though the flanges as such are typically neither worn nor damaged. Plainly, the replacement of the flanges is, in and of itself, needlessly expensive. Replacement is, however, made even more economically disadvantageous by such unitary construction, for, under the circumstances, the attainment of such construction requires that each mold, whether original or replacement, be either forged into blank from billet and then finish-machined, or machined in its entirety from a single large piece of alloy. Either way, allocated capital cost, labor cost, and materials cost combine to adversely affect the cost effectiveness and justification of the continuous casting process and apparatus as a whole.

OBJECTS OF THE INVENTION

It is a primary object of this invention to provide a horizontal, continuous metal casting mold so configured that the flanges required at either end thereof do not have to be replaced each time that normal wear or accidental damage to the casting surface of such mold indicates the necessity of replacement thereof.

It is a further important object of this invention to provide a horizontal, continuous metal casting mold that is so configured that it may be manufactured far more economically than those heretofore known, whether original or replacement, in that it need neither be machined from a single large piece nor finish-machined from a forged blank.

It is a comcomitantly significant object of this invention to provide a multi-piece horizontal continuous casting mold comprising a mold tube and a pair of separate flanges disposed peripherally of either end of said tube and in abutting, liquid-sealing relation therewith, whereby wear or damage to the casting surface of said mold requires replacement of only said tube.

It is another object of this invention to provide an especially effective sealing means disposed between each of said flanges and the respective end of said mold tube which said flange abuts, which means employs the respective liquid-sealing cooperation between a shallow continuous groove formed in and peripherally of each of said mold tube ends and a continuous sharp-edge protrusion formed in and peripherally of each of said flanges.

A still further object of this invention is to provide an improved cooling means disposed peripherally of the outer surface of the mold tube, including a cooling liquid jacket sealingly abutting both flanges and a baffle means for providing a flow of cooling liquid roundabout the tube, such baffle means as such being so configured as to provide a channel immediately circumjacent a substantial portion of the mold tube outer surface for ensuring direct contact between such surface and said cooling liquid flow.

Yet another object of this invention is to provide removable assembly means for releasably interconnecting the two flanges and the baffle means disposed therebetween, while at the same time serving to clamp each of the flanges abuttingly to the respective ends of the mold tube.

SUMMARY OF THE INVENTION

The invention disclosed and claimed herein is a mold for use in the continuous, horizontal casting of metals or steels or other alloys, comprising a mold tube having an input end, an output end, an inner surface adapted to effect casting, and an outer surface. A first flange is disposed peripherally of the input end of the mold tube and having portions positioned in abutting, liquid-sealing relation with cooperating portions of said mold tube, and a second flange is disposed peripherally of the output end of the mold tube and having portions positioned in abutting liquid-sealing relation with cooperating portions of said mold tube. Cooling means are disposed circumjacent the other surface of the mold tube for withdrawing heat therefrom during casting operations.

Additionally, the cooling means may comprise a cooling liquid jacket disposed peripherally of the first and second flanges, and in liquid-sealing relation therewith, while in enveloping relation with the outer surface of the mold tube. The jacket further encompasses and includes therewithin a baffle means for directing a flow of cooling fluid roundabout the mold tube. The baffle means as such is so configured as to define a channel immediately circumjacent at least a substantial portion of the outer surface of the mold tube which serves to provide direct contact between the outer surface and the flow of cooling liquid. Removable fastener or other assembly means releasably secure together the first flange, baffle means and second flange, while at the same time serving to sealingly clamp the first and second flanges abuttingly to the input and output ends respectively of the mold tube.

Further, sealing means are provided at the abutment between the first and second flanges, respectively, and the input and output ends of the mold tube. Preferably, each sealing means comprises an edged, continuous protrusion formed in and disposed peripherally of the flange, and adapted to engage and sealingly cooperate with a continuous groove formed in and disposed peripherally of the end of the mold tube in abutting relation with the flange.

BRIEF DESCRIPTION OF THE DRAWINGS

The foregoing features of the invention will now be described in detail, with reference to the accompanying drawings, in which.

DETAILED DESCRIPTION OF THE INVENTION

Figure 1:
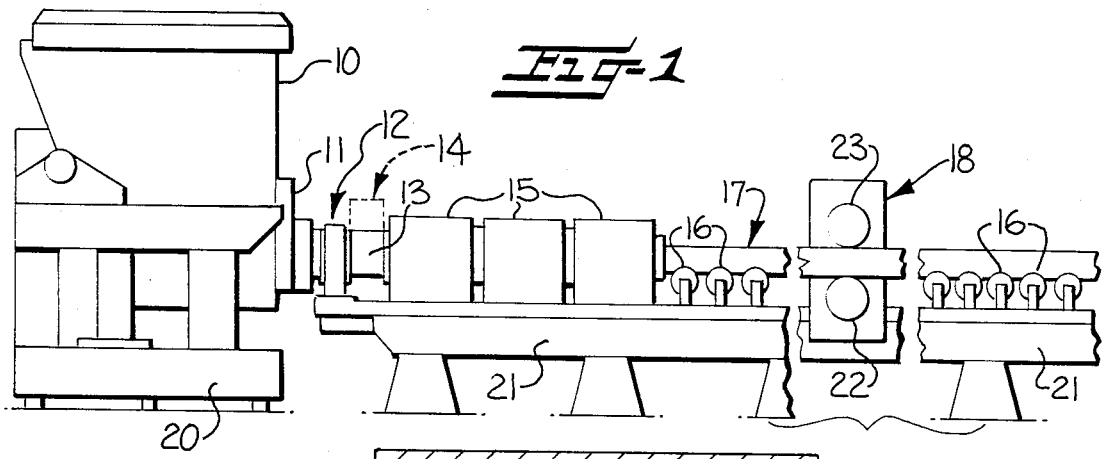
FIG. 1 is a side elevation view of apparatus for horizontally continuously casting metals or alloys, including a mold.

Typical apparatus for horizontally continuously casting steel or other alloys or metals in conjunction with which the mold of the invention is intended to be used is shown in FIG. 1. A tundish 10 is suitably supported from the floor by framework 20, and is adapted to hold and maintain molten a fairly substantial reservoir of liquid metal or alloy of the type selected for the product to be cast. Molten material is supplied from tundish 10 via slide gate 11, through transitional ceramic members not shown, to mold 12, which is the subject of the present invention. Mold 12, which is typically water-cooled, through chilling commences the solidification of the product to be cast, forming the outer shell thereof and thus providing such product with its cross-sectional shape.

A typically water-cooled primary aftercooler 13 abuts mold 12, and serves through further chilling to continue the solidification of the product being cast from the outer surface inward. Electromagnetic stirring means 14 may optionally surround primary aftercooler 13 for purposes of remotely agitating the still-molten core of the product. A number of secondary aftercoolers 15, shown as three in number but which may be more or less than three, are sequentially and abuttingly disposed downstream of the primary aftercooler 13 for receiving and further cooling the product 17 being cast. Mold 12, primary aftercooler 13, and secondary aftercoolers 15 are typically commonly supported from the floor by a suitable sled or framework 21.

The movement of cast product 17, which may be, for example a round bar or a square billet, is effected by withdrawal means 18 disposed downstream of the secondary coolers 15, with suitably supported idler rolls 16 being disposed to supportingly convey the moving product 17 during its passage from coolers to withdrawal means 18 and beyond. Withdrawal means 18 may comprise a driven roll 22 and a hydraulically-loaded pressure roll 23. The motion of driven roll 22 is in most instances periodic and is supplied by a drive system including, for example, a dc torque motor, a position senser and feedback loop, a microprocessor, and a suitable dc power supply, all of which are not shown since they form no part of this particular invention.

Figure 2:
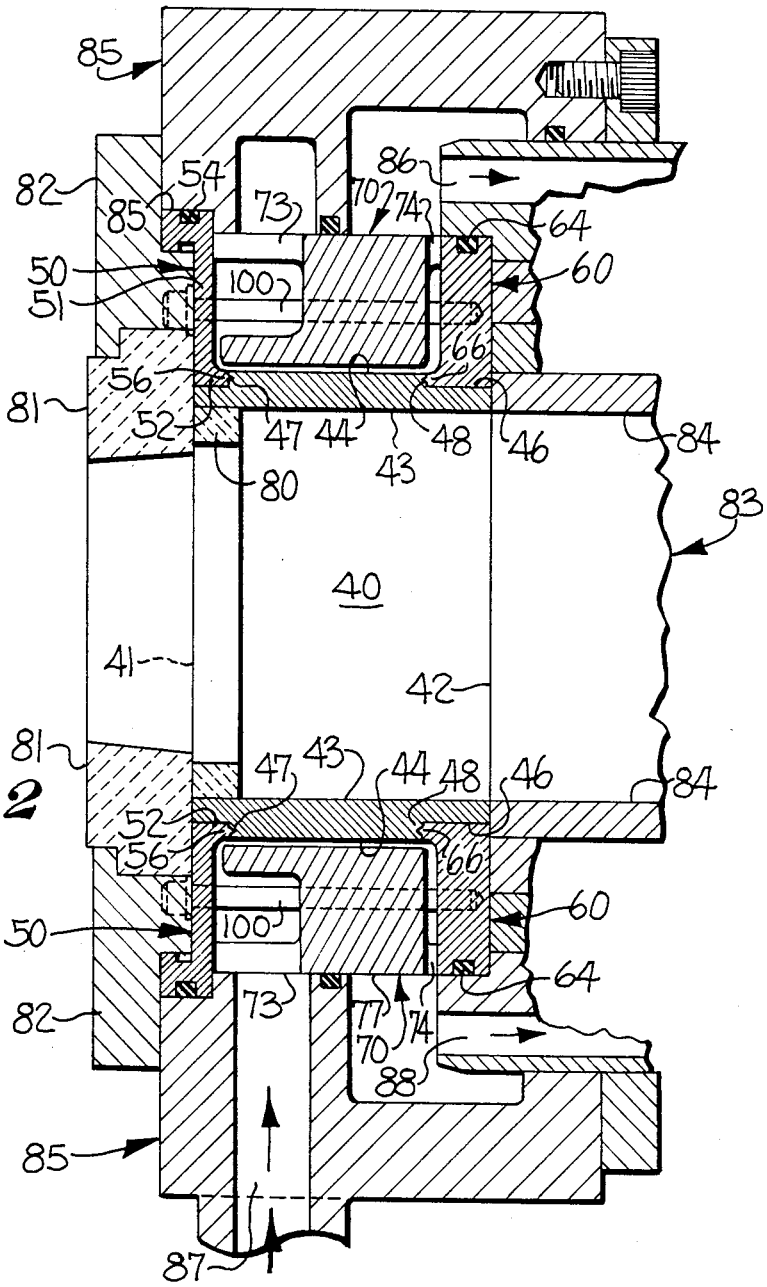
FIG. 2 is a vertical, transverse, cross-sectional view of the mold used in the apparatus of FIG. 1 and its immediate surroundings.

Turning to FIG. 2, mold 12 is shown in cross-sectional detail, being abuttingly connected at its upstream end to the tundish, not shown, via mounting plate 82, refractory member 81 and ceramic break ring 80, as will all be recognized by those familiar with the art. Similarly, mold 12 is abuttingly adjoined at its downstream end by the primary aftercooler shown generally at 83, which preferably includes inwardly movable, product-containing graphite plates 84.

Mold 12 comprises mold tube 40, first flange 50, second flange 60, baffle means 70, and water jacket 85. The mold tube 40, the two flanges 50 and 60, and the baffle 70 are all held together by a plurality of shoulder bolts 100, as will be explained in detail hereinbelow. Water jacket 85 extends surroundingly about the other elements, and forms the peripheral exterior of the mold 12, sealingly abutting both of the flanges 50 and 60 and the baffle means 70. As those familiar with the art will recognize, water jacket 85 may be of any of a variety of sizes and configurations suitably adapted to provide the requisite water flow attendant to the needed amount of cooling, and should be provided with an appropriate water-input-passage such as 87 and appropriate output passages such as 86 and 88, the connections to which are not shown. Naturally, other heat-transfer fluids than water can be utilized.

The principal operating member of mold 12 is mold tube 40, which has an input end 41, an output end 42, an inner surface 43 which is axially uninterrupted and adapted to receive molten metal and chillingly form the shape of the product being cast, and outer surface 44 which is adapted to heat-transferably contact a flow of cooling liquid, such as water. Mold tube 40 is preferably made of beryllium-copper for both strength at elevated temperatures and heat conductivity, and may be formed by any seamless-tube manufacturing process. Inner surface 43 is normally of smooth surface finish, and may be chromium-plated. Such surface is subject to wear during normal use in proportion to the total amount of product cast, thus requiring periodic replacement. Such surface may also be unacceptably marred by careless handling, for example, during assembly or disassembly, and is thus subject to unscheduled replacement as well.

Figure 5:
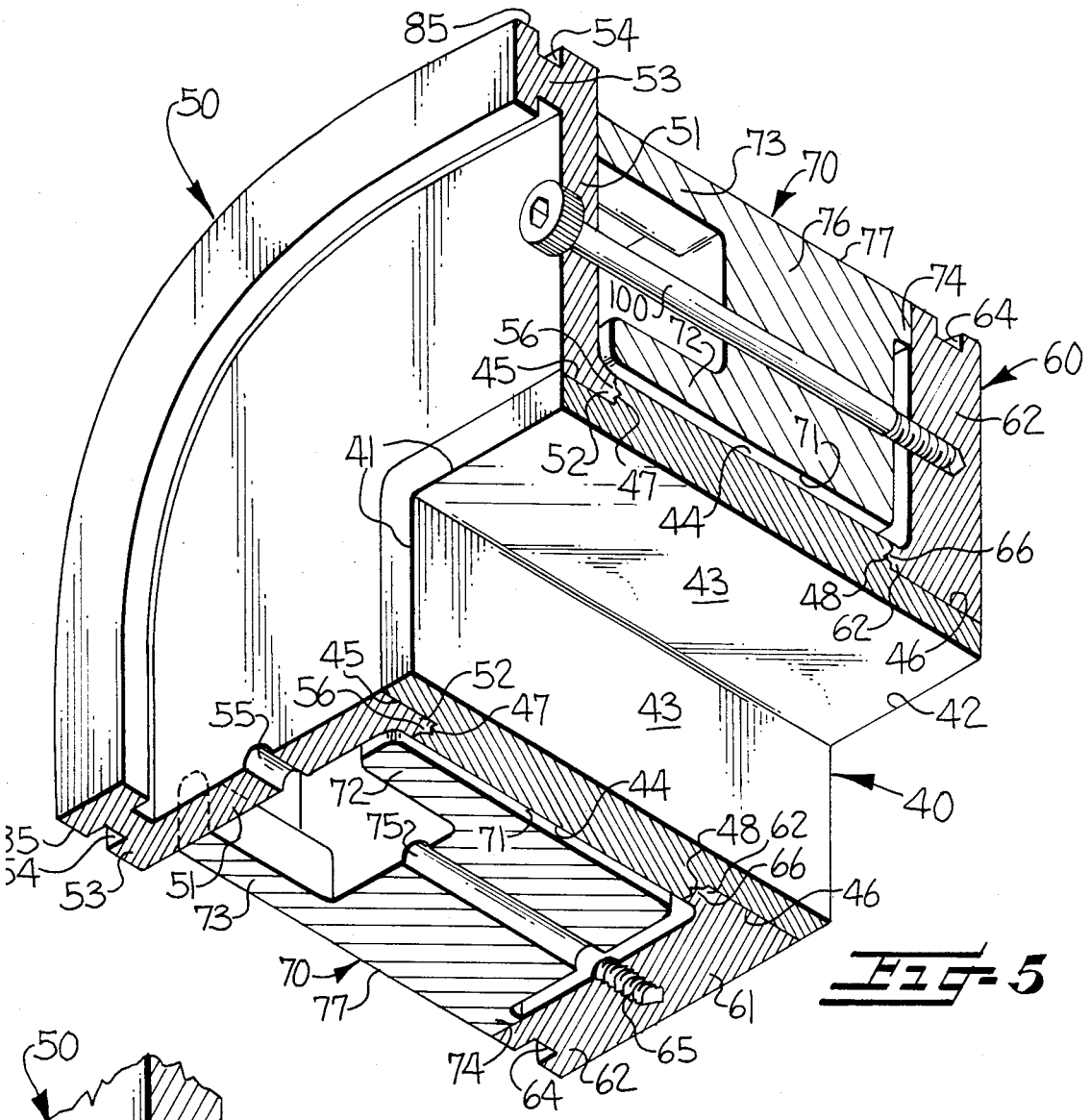
FIG. 5 is a perspective view of a corner of the mold with principal parts assembled, taken in the direction of the arrow 5 shown in FIG. 3, being also in part cross-sectional.

As is, perhaps, more clearly shown in FIG. 5, at the input end 41 of mold tube 40, there is provided peripherally disposed land 45 adapted to abut first flange 50 in liquid-sealing relation, preferably by way of the lap-joint shown. The liquid-tight seal is provided via the cooperation between peripherally disposed continuous protrusion 56 formed in first flange 50 and peripherally disposed continuous groove 47 formed in the radially extending portion of land 45, that is, the portion of such land lying in a plane perpendicular to the mold tube axis. Protrusion 56 is preferably formed so as to be shaped in cross section as a sharp, inverted V, such as would commonly be referred to as knife-edged. Groove 47, when in sealing relation with protrusion 56, is shaped in cross section as a V of depth and width substantially coincident with that of protrusion 56, whereby said liquid-tight seal is obtained. As is explained in greater detail hereinafter in connection with FIG. 6, groove 47 may, prior to being placed in sealing relation with protrusions 56, be of the same but smaller cross section or may be of other cross-sectional shape sized appropriately to effectively cooperate with said protrusion after assembly.

Likewise, as shown in both FIGS. 2 and 5, at the output end 42 of mold tube 40, there is provided peripherally disposed land 46 adapted to abut second flange 60 in liquid-sealing relation, preferably via the lap-joint shown. In similar fashion as at input end 41, the liquid-tight seal is provided via the cooperation between peripherally disposed continuous protrusion 66 formed in second flange 60 and peripherally disposed continuous groove 48 formed in the radially extending portion of land 46, that is, the portion of such land lying in a plane perpendicular to the mold tube axis. Protrusion 66 is shaped similarly to protrusion 56, as explained above. Likewise, groove 48 is shaped similarly to groove 47, also as explained above.

Referring again to both FIGS. 2 and 5, first flange 50 is preferably made of stainless steel via any of several known techniques, and extends peripherally roundabout the input end 41 of mold tube 40. It comprises radially extending web portion 51, inner rim portion 52 adapted to sealingly abut land 45, and outer rim portion 53 adapted to sealingly abut water jacket 85 via an O-ring disposed in peripherally formed continuous O-ring groove 54. As aforesaid, the continuous, sharp-edged protrusion 56 is formed in the upstream radially extending surface of rim portion 52, that is, the surface lying in a plane perpendicular to the flange axis, and is adapted to sealingly cooperate with peripherally disposed groove 47 substantially throughout its entire extent. A plurality of holes 55 have been formed at selected intervals in web 51 via any suitable means at a radial location generally intermediate the inner and outer rim portions 52 and 53, and are of a size to snugly receive the shoulder portions of shoulder bolts 100.

Likewise, as shown in both FIGS. 2 and 5, second flange 60 is also preferably made of stainless steel, and extends peripherally roundabout the output end 42 of mold tube 40. It comprises radially extending web portion 61, inner rim portion 62 adapted to sealingly abut land 66, and outer rim portion 63 adapted to sealingly abut water jacket 85 via an O-ring disposed in peripherally formed continuous O-ring groove 64. Also as aforesaid, the continuous, sharp-edged protrusion 66 is formed in the downstream radially extending surface of rim portion 62, that is, the surface lying in a plane perpendicular to the flange axis, and is adapted to sealingly cooperate with peripherally disposed groove 48 substantially throughout its entire extent. A plurality of threaded holes 65 have been formed in web 61 via any suitable means at intervals selected to match those utilized in locating holes 55 in web 50, and at radial locations generally intermediate rim portions 62 and 63 and equal to those utilized in locating holes 55 in web 51. Threaded holes 65 are adapted to snugly receive the threaded end portions of shoulder bolts 100.

Referring again to both FIGS. 2 and 5, baffle means 70 extends peripherally roundabout outer surface 44 of mold tube 40, is disposed generally between first and second flanges 50 and 60, and includes a peripheral central block portion 76 having an outer surface 77 adapted to sealingly abut water jacket 85, said block portion 76 being of an axial length substantially less than the distance between first and second flanges 50 and 60. Lower lip portion 72 is peripherally continuous, extends axially upstream of central block portion 76, and is formed contiguous with the radially inward portion of central block 76 so as to present a common, uninterrupted peripheral inner surface 71. First intermittent upper lip portions 73 are formed at selected peripheral intervals, extend axially upstream of central block portion 76, and are generally radially disposed coextensively with outer surface 77. Second intermittent upper lip portions 74 are formed at peripheral intervals selected to match those attendant to first intermittent upper lip portions 73, and at substantially the same radial location, but extend axially downstream of central block portion 76.

A plurality of holes 75 are formed via any suitable means in central block portion 76 at peripheral intervals selected to match those attendant to the location of holes 55 in web 51 and holes 65 in web 61. Holes 75 are adapted to snugly receive the shank portions of shoulder bolts 100, and are radially located outwardly of inner surface 71 a distance selected to provide a peripherally continuous gap of predetermined radial extent between inner surface 71 of baffle means 70 and outer surface 44 of mold tube 40. Such gap defines a peripherally continuous water passage which lies immediately circumjacent outer surface 44 and serves to assure direct contact between the flow of cooling water and said outer surface, thus maximizing heat transfer away from the mold tube 40.

The axial extent of second intermittent upper lips 74 serves to define an outlet water passage between central block 76 and second flange 60, said water passing outwardly into the water jacket 85 via the spaces between said second intermittent lips. Likewise, the axial extent of first intermittent upper lips 73 defines a large first input water passage, said water passing inwardly from the water jacket 85 via the spaces between said first intermittent lips. Continuous lower lip 72 extends axially upstream a distance less than do first intermittent upper lips 73, the difference in axial distance serving to define a second input water passage which serves to connect the large passage with the passage adjacent the outer surface 44 of the mold tube, and which is axially located between lip 72 and flange 50 and extends continuously peripherally of inner rim portion 52. Thus, cooling water flows from water jacket 85 through the spaces between first intermittent lips 73, and sequentially through the large first passage, the second passage, the passage adjacent the mold tube, and the outlet passage, and thence through the spaces between second intermittent lips 74 back to water jacket 85, whilst also extending peripherally all about outer surface 44 of mold tube 40. This is, perhaps, best shown in FIG. 5.

Figure 3:
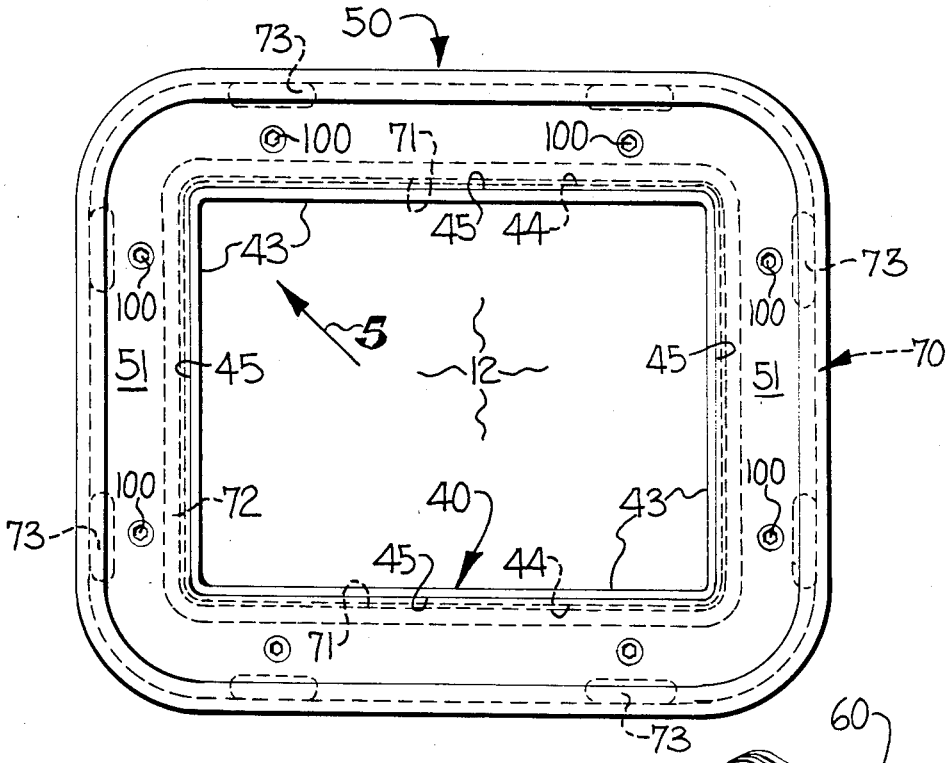
FIG. 3 is a front view of the mold shown in FIG. 2 as assembled, looking toward the input end thereof.

Referring to FIG. 3, the mold 12 is shown assembled in front elevation, as seen looking into input end 41 of mold tube 40. For clarity, the break ring 80, refractory member 81 and mounting plate 82 as shown in FIG. 2 are not shown in FIG. 3. The shape of inner surface 43 of mold tube 40 is depicted as rectangular in this instance, such as would be suitable for casting 5"×7" billet, for example. As those skilled in the art will recognize, such inner surface 43 could handily be of any of a wide variety of sizes or other shapes, depending on the product to be cast. Readily envisioned alternatives would include round, or square, or octagonal, for example.

Shown in FIG. 3, as solid lines, moving from the center to the exterior of mold 12, are, first, interior surface 43 of mold tube 40, then the juncture of land 45 of mold tube 40 and inner rim 52 of first flange 50, next the plurality of shoulder bolts 100 peripherally spaced at selected intervals, then the lower edge of outer rim 53 of first flange 50, then the juncture of the upper surface of the outer rim 53 of first flange 50 and water jacket 85, and finally the exterior surface of water jacket 85. Shoulder bolts 100 extend, as shown in FIG. 2, inwardly through holes 55 in web 51 of first flange 50, and holes 75 in baffle means 70, and are threaded into threaded holes 65 in web 61 of second flange 60. For clarity, no representation of these holes appears in FIG. 3.

Shown in FIG. 3, as hidden, dotted lines, again moving from the center to the exterior of mold 12, are, first, the outer surface 44 of mold tube 40, and next the common inner surface 71 of continuous lip 72 and central block 76 of baffle means 70. Outer surface 44 and inner surface 71 also serve to define the cooling water passage disposed immediately circumjacent such outer surface of the mold tube 40. The juncture of protrusion 56 and groove 47 is not shown here, by reason of size limitations, but is shown in detail in FIG. 6.

Next, there is shown in FIG. 3 in dotted lines the upper surface of continuous lip 72 of baffle means 70, and then the inner surfaces, outer surfaces and sides of intermittent lips 73 of baffle means 70, and finally O-ring groove 54 in outer rim 53 of first flange 50. Intermittent lips 73 are peripherally spaced apart at selected intervals, here shown as generally matching the intervals selected for bolts 100. The spaces between intermittent lips 73 define passages that permit the flow of cooling water from water jacket 85 into the first large passage as shown in FIG. 2. For clarity, intermittent lips 74 of baffle means 70 are not shown in FIG. 3, but may be taken as generally coinciding in location and size with intermittent lips 73 as shown in FIG. 3.

Figure 4:
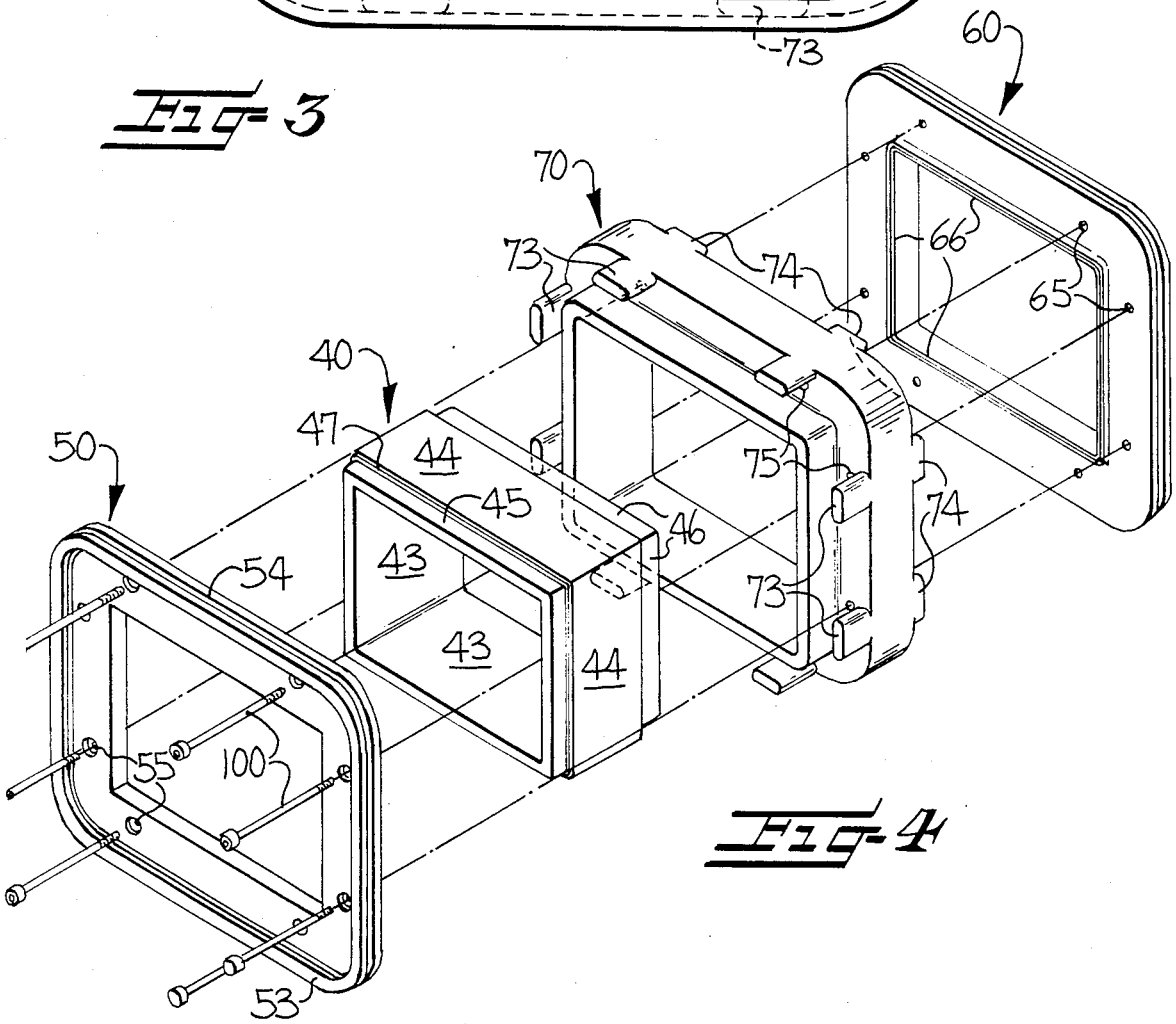
FIG. 4 is an exploded perspective view of the mold shown in FIGS. 2 and 3, showing in general the way in which the principal parts of the mold appear upon disassembly and prior to reassembly.

In FIG. 4, there is shown an exploded perspective view of the mold as it would appear upon disassembly. Depicted therein are mold tube 40, first flange 50, baffle means 70, second flange 60, and shoulder bolts 100, as they would appear when looking toward input end 41 of mold tube 40. Again, as in FIG. 3, break ring 80, refractory member 81 and mounting plate 82 are not shown in the interest of clarity. Similarly, water jacket 85 is not included, so that the relationship between the two flanges, the mold tube, and the baffle means may more readily be appreciated.

Attention is particularly directed to baffle means 70. Intermittent lips 73 are best shown in this view, as are the passages therebetween for the inward flow of cooling water. Intermittent lips 74 are also clearly visible, as are the passages therebetween for the outward flow of cooling water.

Also visible is shallow groove 47, as it would appear as formed in the radially extending portion of land 45 of mold tube 40 via sealing cooperation with peripheral protrusion 56. Shallow groove 48, not visible, is of similar shape and location. Likewise, sharp-edged protrusion 66 formed in lower rim 62 of second flange 60 is visible. Sharp-edged protrusion 56, not visible, is of similar shape and location. The shape and size of both grooves 47 and 48, and both protrusions 56 and 66 are best seen in FIG. 6, as further explained hereinafter.

When the parts shown in FIG. 4 have been reassembled, shoulder bolts 100 extend snugly through holes 55 in first flange 50, and holes 75 in baffle means 70, and are threadingly tightened into threaded holes 65 in second flange 60. Thus, outer rim 53 of first flange 50 and intermittent lips 73 of baffle means 70 are clamped together, as are intermittent lips 74 of baffle means 70 and outer rim 63 of second flange 60. At the same time inner rim 52 of first flange 50 is clamped to land 45 of mold tube 40, as is inner rim 62 of second flange 60 to land 46 of mold tube 40. These relations are shown in FIG. 2. Thus clamped, sharp-edged protrusion 56 forceably and sealably engages shallow groove 57, and sharp-edged protrusion 66 forceably and sealably engages shallow groove 48.

Figure 6:
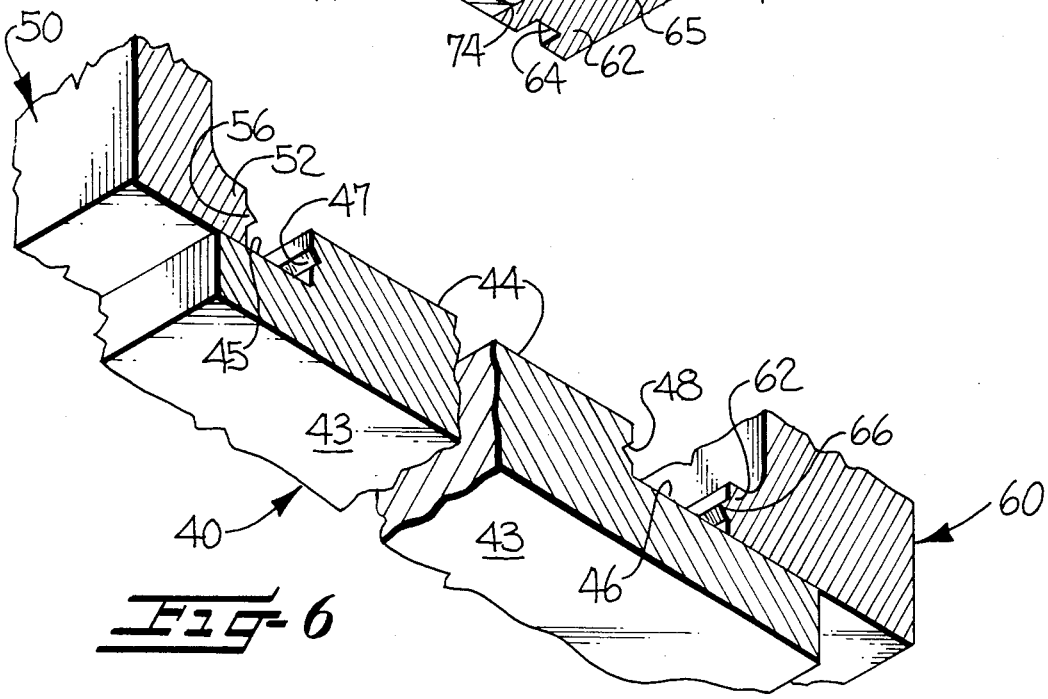
FIG. 6 is a detailed perspective view showing the way in which certain principal parts of the mold fit together in liquid-sealing relation, being also in part cross-sectional.

Referring now to detailed perspective FIG. 6, the aforementioned relationship of protrusions 56 and 66 with, respectively, grooves 47 and 48 is readily appreciated. As will be recognized, the flanges and their respective protrusions are of relatively hard stainless steel, and the mold tube and its respective edge material defining said grooves are of relatively soft copper alloy, so that, when the mold parts are clamped together, the protrusions will tend to swage into the grooves, when both are properly shaped and sized. Through such swaging relationship, a robust, liquid-tight seal is formed.

As fabricated initially, mold tube 40 may include peripheral grooves 47 and 48 which have been machined therein or otherwise formed therein and which are so configured as to have a V-shaped cross section of depth and width similar to but somewhat smaller than those attendant to the inverted V cross section of protrusions 56 and 66. The eventual V-shape cross section of said grooves as heretofore shown is then acquired via the aforementioned swaging action resulting from the flanges 50 and 60 being clamped to mold tube 40.

In similar fashion, another alternative provides mold tube 40 with peripheral grooves 47 and 48 of shallow U-shaped cross section, such as might be placed in the radially extending portions of, respectively, lands 45 and 46 via impressing or embossing operations or the like. Again, the eventual V-shaped cross section of said grooves, as shown in FIG. 6, is obtained via the hard stainless steel protrusions swaging into the softer copper alloy.

Indeed, as those skilled in the art will appreciate, the grooves provided in mold tube 40 as initially fabricated may be little more than just scribed lines appropriately located on said radially extending surfaces of said lands so as to mate with the respective apexes of said knife-edged protrusions. Further, upon proper selection of a sufficiently hard stainless steel for the flanges and a sufficiently workable copper alloy for the mold tube, and upon proper configuration of the inverted V-shaped cross section of the protrusions, the peripheral grooves need not be present at all in the mold tube as initially fabricated. In this latter alternative, the eventual V-shape cross section of the grooves as shown in FIG. 6 is acquired in its entirety via swaging.

Of course, as those of skill in the art will also readily appreciate, the liquid-sealing relation between each flange respectively and the mold tube need not be provided via cooperation between edged protrusions and shallow grooves, though that is preferred. Instead, a suitably sized and located O-ring groove could readily be provided in each instance, and appropriately fitted in each case with a suitably-sized, high-temperature-resistant O-ring.

There has thus been provided a mold tube 40 which is quite simple in structure and readily manufactured. Replacement of such tube is quite handily accomplished via non-complex disassembly, whether the need for replacement arises through normal wear or through accidental damage. Indeed, all that one needs to do is remove the shoulder bolts, dissassemble the unit by removing the baffle from around the outer surface of the tube, remove the first and second flange from the ends of the tube, replace the tube, reposition the first and second flanges, reposition the baffle, and re-engage the shoulder bolts. Thus, not only is the mold tube itself considerably less costly than those heretofore known, but labor costs in disassembly and reassembly have been held to quite reasonable levels.

In the drawings and specification there has been set forth a preferred embodiment of the invention, and although specific terms are employed, they are used in a generic and descriptive sense only and not for purposes of limitation.

That which is claimed is:

1. A mold for use in the horizontal, continuous casting of metals or steels or other alloys, comprising:

a mold tube having an input end, an output end, an inner surface adapted to effect casting, and an outer surface, a first flange extending peripherally roundabout the input end of the mold tube and having portions positioned in abutting, liquid-sealing relation with cooperating portions of said mold mold tube, a second flange extending peripherally roundabout the output end of the mold tube and having portions positioned in abutting, liquid-sealing relation with cooperating portions of said mold tube, cooling means disposed circumjacent said outer surface of said mold tube for withdrawing heat therefrom, first sealing means clampedly interposed at the abutment between said first flange and the input end of said mold tube, second sealing means clampedly interposed at the abutment between said second flange and the output end of said mold tube, means removably securing said first and second flanges in assembled, liquid-sealing relation with said mold tube such that a drawing force is applied between said first and second flanges thereby compressively captivating said mold tube therebetween.

2. A mold according to claim 1, wherein said first sealing means is carried by said first flange and said second sealing means is carried by said second flange and wherein said first and second sealing means each comprise an edged continuous protrusion formed in the respective flange and positioned to engage and sealingly cooperate with a continuous groove formed in th cooperating portion of said mold tube.

3. A mold for use in the horizontal, continuous casting of metals or steels or other alloys, comprising:

a mold tube having an input end, an output end, an inner surface adapted to effect casting, and an outer surface, a first flange extending peripherally roundabout the input end of the mold tube defining a first plurality of apertures and having portions positioned in abutting, liquid-sealing relation with cooperating portions of said mold tube, a second flange extending roundabout the output end of the mold tube defining a second plurality of apertures aligned with said first plurality of apertures and having portions positioned in abutting, liquid-sealing relation with cooperating portions of said mold tube, a cooling liquid jacket disposed peripherally of said first and second flanges and in liquid sealing relation therewith, and further disposed in enveloping relation with the outer surface of the mold tube, said jacket including therewithin baffle means for directing a flow of cooling fluid peripherally of said mold tube, said baffle means further defining a third plurality of apertures aligned with said first and second plurality of apertures and so configured as to define a channel immediately circumjacent at least a substantial portion of said outer surface of said mold tube and adapted to provide direct contact between said outer surface and said flow of cooling liquid, and a plurality of removable fastener means extending through said first, second and third pluralities of apertures releasably securing said first and second second flanges in said abutting, liquid-sealing relation with said mold tube thereby compressively captivating said mold tube between said first and said second flanges, and said removable fastener means also securing said baffle means in assembled relation cooperating with said mold tube.

4. An improved mold for use in apparatus for horizontally, continuously casting steel or the like, comprising:

a mold tube having an interruption-free interior casting surface, an outer surface, an input end, and an output end, first and second flanges respectively extending peripherally roundabout said input and output ends and having portions thereby positioned in abutting, lap-joint relation with cooperating portions of said mold tube, sealing means respectively disposed with each of said lap-joint abutments, baffle means interconnecting said first and second flanges, disposed peripherally of said tube and adapted to direct a flow of cooling liquid over a substantial portion of said outer surface, jacket means having a cooling liquid inlet and outlet, disposed so as to encompass said baffle means and in abutting, liquid-sealing relation with said first and second flanges, and adapted to supply a flow of cooling liquid to, through, and from said baffle means, and a plurality of removable securing means adapted to releasably hold said mold tube, said first and second flanges, and said baffle means all together as a single assembly whereby said mold tube is captivated in compression between said first and second flanges.

5. A mold as in claim 4, wherein both of said first and second flanges further comprise first engaging means adapted to cooperate with said plurality of removable securing means, said first engaging means being disposed outwardly of the outer surface of said tube a first predetermined distance when said flanges are disposed in abutting relation with the ends of said tube, and said baffle means further comprises second engaging means adapted to cooperate with said plurality of removable securing means, and an inner surface disposed inwardly of said second engagement means a second predetermined distance less than said first predetermined distance, whereby, when said single assembly is formed, said inner surface of said baffle means stands away from the outer surface of the mold tube a distance equal to the difference between said first and second predetermined distances, and there is thus defined a channel immediately circumjacent said outer surface adapted to provide direct contact between said outer surface and said flow of cooling liquid.

6. In combination with apparatus for continuously horizontally casting steel or other metals or alloys including a tundish upstream of a casting mold and one or more after coolers and a withdrawal means sequentially downstream of said mold, an improved configuration for said mold comprising:

a mold tube having an input end adapted to receive molten metal from said tundish and an output end adapted to deliver the metal to said coolers, a continuous shallow groove formed in and disposed peripherally about one end of said mold tube, a first flange extending peripherally roundabout and abutting said one of said mold tube and having formed therein and disposed peripherally thereof a continuous, knife-edged protrusion engaging said groove in liquid-sealing relation;

a second continuous, shallow groove formed in and disposed peripherally about the other end of said mold tube, a second flange extending peripherally roundabout and abutting said other end of said mold tube and having formed therein and disposed peripherally thereof a continuous, knife-edge protrusion engaging said second groove in liquid-sealing relation; and means interconnecting said first and second flanges for compressively captivating said mold tube therebetween and sealably securing said flanges respectively to said one and said other ends of said mold tube.

7. Apparatus according to claim 6 wherein said mold tube includes a peripherally disposed land adjacent each end thereof defining respective shoulder portions lying in a plane generally perpendicular to the axis of the mold tube, and wherein said continuous shallow grooves are located in said perpendicularly oriented shoulder portions, and wherein said first and second flanges include rim portions lying in a plane generally perpendicular to the axis of said mold tube, with said knife-edged protrusions being located in said rim portions and positioned for engaging said grooves on said mold tube, and wherein said means interconnecting said first and second flanges comprises threaded fastener means extending generally parallel to the axis of said mold tube and cooperating with said first and second flanges for drawing the same towards one another so that said protrusions are tightly seated in said grooves to form an effective liquid seal.

8. Apparatus according to claim 7 wherein said first and second flanges including said knife-edge protrusions are formed of a relatively hard metallic material and said mold tube including the portions defining said grooves is formed of a relatively soft metallic material and wherein said knife-edge protrusions and said shallow grooves are each respectively so configured that the cross-sectional dimensions of said protrusions are larger than the cross-sectional dimensions of said grooves, so that when said fastener means draw said flanges toward one another said protrusions forceably engage said grooves and swageably seat themselves therein to form said liquid-tight seals.

9. A mold tube for use in a horizontal continuous metal casting mold of the type which comprises a mold tube and first and second flanges respectively disposed peripherally of opposite ends of said mold tube, said mold tube comprising an elongate hollow tubular member having an interruption-free interior casting surface, an outer surface, an input end, and an output end, a peripherally disposed land on the outer surface of said mold adjacent said input and output ends of said tube and defining respective shoulder portions lying in a plane generally perpendicular to the axis of the mold tube, and a continuous peripherally extending shallow groove located in each of said shoulder portions adapted to be engaged by correspondingly located knife edge projections on the first and second flanges to form a liquid tight seal when flanges are assembled with the mold tube, and fastening means coupled to said first and second flanges exerting a drawing force therebetween to exert a compressive force upon said lands and said shoulder portions such that said knife edge projections are driven into said shallow grooves.

10. A method for replacing in a horizontal continuous metal casting mold a mold tube having a damaged casting surface;

said mold including a mold tube having an inner casting surface, an outer casting surface, and input and output ends each providing a peripherally disposed surface perpendicular to the mold tube axis with a shallow peripheral groove formed therein, and first and second flanges respectively disposed peripherally about said input and output ends and in abutting, liquid-sealing relation therewith, said flanges each including a peripheral rim surface perpendicular to the flange axis with a knife-edged peripherally disposed protrusion formed therein and adapted to sealingly engage said groove, and tightenable removable securing means disposed axially of said mold at selected peripheral intervals for drawing together toward one another and first and second flanges and compressively captivating said tube therebetween to form a unitary assembly, said method comprising the steps of:

disassembling said mold by removing said securing means and respectively parting said abutments between said mold tube and said first and second flanges;

replacing said mold tube with another mold tube having the same configuration and an undamaged casting surface;

positioning said first and second flanges respectively adjacent the input and output ends of the replacement mold tube such that the protrusions formed on said flanges respectively adjoin the grooves formed in the ends of said tube;

installing said removable securing means and drawing said first and second flanges toward one another so that they respectively abut said input and output ends of said replacement mold tube; and tightening said securing means, thereby compressing said tube between said first and second flanges forcing said protrusions swageably into said grooves, respectively, and thus reestablishing said liquid-tight seals at the abutments at both ends of said replacement mold tube while at the same time interconnecting said first and second flanges and said replacement mold tube into a unitary assembly.

* * * * *